US005575211A

United States Patent [19]

Harrison

[11] Patent Number: 5,575,211

[45] Date of Patent: Nov. 19, 1996

[54] WASHING ARRANGEMENT FOR ROTARY PRINTER

[75] Inventor: Frederick W. Harrison, Kalamazoo, Mich.

[73] Assignee: Hycorr Machine Corporation, Kalamazoo, Mich.

[21] Appl. No.: 496,927

[22] Filed: Jun. 30, 1995

Related U.S. Application Data

[63] Continuation of Ser. No. 331,009, Oct. 28, 1994, abandoned.

[51] Int. Cl.[6] ..... B41F 35/00

[52] U.S. Cl. ..... 101/425; 101/423; 15/256.52; 118/70; 118/203

[58] Field of Search ..... 101/423, 424, 101/425; 15/256.51, 256.52; 118/70, 203

[56] References Cited

U.S. PATENT DOCUMENTS

| | | | |
|---|---|---|---|
| 1,378,278 | 5/1921 | Roberts | 101/425 |
| 2,944,484 | 7/1960 | Bruce | 101/425 |
| 3,737,940 | 6/1973 | Moestue et al. | 101/425 |
| 3,800,702 | 4/1974 | Roberts | 101/425 |
| 4,015,307 | 4/1977 | Kossak | 15/256.52 |
| 4,270,450 | 6/1981 | Difflipp et al. | 101/142 |
| 4,393,778 | 7/1983 | Kaneko | 101/425 |
| 4,499,825 | 2/1985 | Uno | 101/425 |
| 4,747,348 | 5/1988 | Jeschke et al. | 101/425 |
| 5,010,819 | 4/1991 | Uribe et al. | 101/425 |
| 5,035,178 | 7/1991 | Jahn et al. | 101/425 |
| 5,086,701 | 2/1992 | Gasparrini et al. | 101/425 |
| 5,109,770 | 5/1992 | Uribe et al. | 101/425 |
| 5,181,470 | 1/1993 | Barrois et al. | 101/425 |
| 5,209,164 | 5/1993 | Durrnagel et al. | 101/425 |
| 5,235,913 | 8/1993 | Richardson et al. | 101/425 |
| 5,265,537 | 11/1993 | Gasparrini et al. | 101/425 |
| 5,299,495 | 4/1994 | Schoeps et al. | 101/425 |
| 5,303,652 | 4/1994 | Gasparrini et al. | 101/425 |
| 5,322,015 | 6/1994 | Gasparrini | 101/425 |
| 5,325,780 | 7/1994 | Matsuda et al. | 101/424 |
| 5,367,982 | 11/1994 | DeMoore et al. | 118/203 |
| 5,385,095 | 1/1995 | Waizmann | 101/424 |
| 5,390,598 | 2/1995 | Stauffer | 101/425 |
| 5,402,724 | 4/1995 | Yaeso et al. | 101/424 |
| 5,438,923 | 8/1995 | Schoeps | 101/425 |
| 5,463,951 | 11/1995 | Waizmann et al. | 101/423 |

*Primary Examiner*—Eugene H. Eickholt

*Attorney, Agent, or Firm*—Flynn, Thiel, Boutell & Tanis, P.C.

[57] ABSTRACT

A washing apparatus for a printing roll, particularly a flexographic printing roll having raised printing areas. The washing apparatus includes a troughlike housing provided with an open mouth positioned adjacent the peripheral surface of the printing roll. The housing, surrounding the open mouth, has sealing strips which engage the print roll surface. First and second nozzles are mounted in the housing for respectively discharging streams of cleaning liquid and rinsing liquid against the periphery of the roll as it moves past the mouth of the housing. A brush is positioned within the housing for contacting the print areas on the roll generally between the regions contacted by the nozzle streams. The liquid and debris collect within the housing, and are sucked therefrom for exterior discharge.

26 Claims, 5 Drawing Sheets

WASHING ARRANGEMENT FOR ROTARY PRINTER

This application is a continuation of now abandoned U.S. Ser. No. 08/331,009, filed Oct. 28, 1994.

FIELD OF THE INVENTION

This invention relates to a cleaning arrangement for a rotary printer and, more specifically, to an improved washing arrangement which cooperates with a flexographic print roll.

BACKGROUND OF THE INVENTION

In flexographic printing, there is provided a print roll having raised print surfaces. This is accomplished by providing a main support roll (i.e. a plate cylinder) having a generally cylindrical surface on which a printing plate with raised letters or characters is secured. The printing plate is usually formed by a supporting or backing plate which is generally of small thickness such as about 0.030 inch, and one or more raised print plate parts are secured to and project upwardly from the backing, with the print plate parts having a thickness which varies but typically are about 0.250 inch. Typically a liquid ink is used which is applied from the source, such as a typical ink supply fountain using a doctor blade, to an intermediate roller which is normally referred to as an anilox roll. This anilox roll has finely engraved meshlike depressions in its surface for picking up the ink. A doctor blade or other means remove excess ink from the anilox roll surface. The anilox roll then transfers the ink to the raised print areas on the print roll, and the latter in turn effects printing on the work product such as a corrugated paperboard, paper or the like.

During printing, particularly after a significant number of printing cycles, debris tends to collect on the print plate which hence interferes with precise printing. This debris typically is minute paper particles which are associated with the paperboard being printed. Due to this collection of debris on the print roll, or due to the necessity of having to change ink colors, it is necessary to periodically clean or wash the print plate. In the past, the washing of the print plate on flexographic printers has typically been a manual operation, requiring separation of printing sections of the machine and loss of print color registration and has occasionally required removal of the plate from the cylinder in as much as manual washing of the print plate on the machine is messy and complex.

While attempts have been made to provide a washing apparatus for a rotary print roll, these attempts have been primarily in relationship to lithographic (i.e. offset) printers, and the washing arrangements which have been utilized for lithographic printers are not believed to possess all of the properties necessary or desirable for use in effecting proper washing of a printing plate on a flexographic printer.

More specifically, in lithographic printing the print roll is not provided with raised print areas. Rather, a lithographic print roll typically has a rubber blanket which surrounds the roll and defines thereon a flat or generally planar printing area, in contrast to raised print areas in flexographic printing. The printing blanket on the lithographic roll receives ink from an imaged printing plate or transfer roll, and the overall process for picking up and transferring ink involves the use of hydrophilic and hydrophobic areas on the printing plate for controlling the ink and affecting printing of the desired material. Because of the smooth or generally flat print surface defined on the blanket of the lithographic print roll, cleaning of the roll is a much simpler process because of the lack of surface variations and protrusions which exist on a flexographic print roll. Further, the smooth surface characteristic of the lithographic print roll often normally permits the cleaning to be accomplished during the normal rotational cycle of the lithographic print roll, and such is generally not feasible with a flexographic print roll.

Examples of prior art attempt to provide cleaning of print rolls, including lithographic print rolls, are shown in the following U.S. Pat. Nos.: 4,270,450, 4,393,778, 5,010,819, 5,209,164, 5,235,913, 5,265,537 and 5,303,652.

Accordingly, it is an object of this invention to provide an improved washing arrangement for cooperation with a rotary print roll to effect cleaning of ink and debris from printing areas on the print roll, which washing apparatus is particularly suitable for use with print rolls having raised print areas such as a flexographic print roll.

More specifically, in the present invention a washing apparatus is positioned adjacent the periphery of the print roll and extends longitudinally along the length thereof. The washing apparatus includes an elongate housing which mounts thereon a first longitudinally elongate spray bar which mounts one or more nozzles for directing a cleaning liquid against the peripheral surface of the print roll. The housing also mounts a second spray bar which includes one or more nozzles for directing a rinsing liquid against the peripheral surface of the print roll, with the rinsing spray bar being spaced from the first-mentioned spray bar in the direction of rotation of the print roll. A moving brush is also positioned in the housing generally between the spray bars for effecting brushing of the raised print areas after the cleaning liquid has been applied thereto. The liquid and debris used in the cleaning operation collect in the housing and are evacuated therefrom.

In the improved washing arrangement of the invention, as aforesaid, the housing is preferably formed as an elongate channellike trough open on one side which generally faces the periphery of the print roll. The spray bar nozzles extend longitudinally of the trough and are directed to discharge outwardly through the mouth of the trough for applying the cleaning and rinsing liquids to the print areas. The trough is generally oriented with the mouth thereof projecting somewhat sidewardly toward the roll so that the cleaning nozzles are positioned above the rinsing nozzles to facilitate the flow and collection of the liquids and debris.

In the washing apparatus of the invention, as aforesaid, the trough is provided with sealing strips formed preferably as brush strips which extend along both the longitudinally and end edges of the trough opening for maintaining a rubbing engagement with the print roll. These edge brushes maintain contact with the basic surface of the print cylinder in those areas not contacted by the backing of the printing plate, with the brushes being suitably deflectable so as to also maintain proper engagement with both the backing or the print areas as the print roll moves past the washing apparatus. The edge brushes act as partial seals so as to maintain the liquids and debris within the cleaning region defined between the open trough and the periphery of the print roll.

In the washing arrangement of this invention, as aforesaid, the housing or trough is preferably mounted on a pivot arrangement which enables it to pivotably move between an operational position adjacent the print roll and a non-operational position pivoted outwardly away from the print roll when washing is not required. Pivot supports are preferably provided at each end of the housing or trough. The pivot shaft at one end also preferably is hollow at least in part, and extends generally into the lower portion of the collection cavity defined within the trough, and an outer end of the pivot shaft is connected to a suitable vacuum source so as to effect evacuation of the liquids and debris which collect within the trough during the washing operation. The edge brushes also are effective in permitting limited quantities of outside air to flow through the brushes into the interior of the trough so as to effect confinement of the washing and rinsing liquids within the trough and evacuation thereof through the suction tube.

Other objects and purposes of the invention will be apparent to persons familiar with printing processes upon reading the following specification and inspecting the accompanying drawings.

Figure 1:
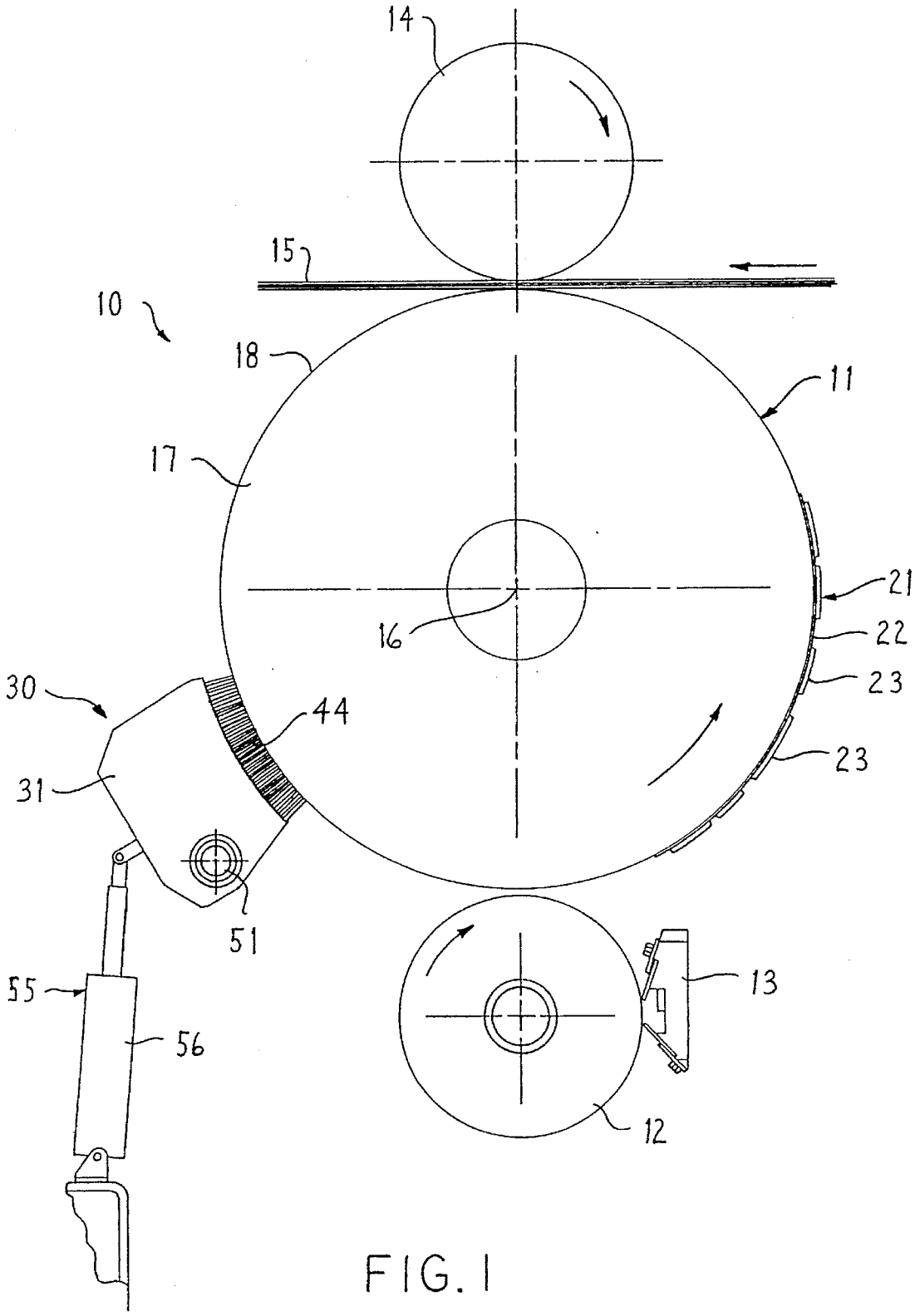
FIG. 1 is an elevational schematic view of parts of a flexographic printing press in accordance with the present invention.

Certain terminology will be used in the following description for convenience and reference only, and will not be limiting. For example the words "upwardly", "downwardly", "rightwardly" and "leftwardly" will refer to directions in the drawings to which reference is made. The words "inwardly" and "outwardly" will refer to directions toward and away from the geometric center of the roll or washing apparatus or designated parts thereof. Said terminology will include the words specifically mentioned, derivatives thereof, and words of similar import.

DETAILED DESCRIPTION

Referring to FIG. 1, there is schematically illustrated a flexographic printing press 10 which includes a printing roll 11 which cooperates with an anilox roll 12, the latter receiving ink on the cylindrical peripheral surface thereof from a conventional ink source 13, such as an ink reservoir having a doctor blade for applying ink to the surface of the anilox roll 12. The print roll 11 cooperates with an impression roll 14 positioned above the print roll so that an object to be printed, such as a corrugated paperboard blank 15, can be fed into and through the nip between the rolls 11 and 14 to permit printing on the undersurface of the blank 15.

The print roll 11 is normally supported so as to be rotatable about its axis 16, the latter generally extending horizontally, with all of the rolls being rotatable substantially as illustrated by the arrows shown in FIG. 1.

The print roll is defined by a print cylinder 17 having a generally smooth exterior cylindrical surface 18. One or more printing plates 21 are secured onto the exterior surface 18 of the plate cylinder 17, with each printing plate 21 typically including a thin backing plate 22 (which for example will have a thickness of about 0.030 inch), and this backing plate 22 in turn will have one or more raised print plate areas 23 secured thereto and projecting outwardly therefrom. The print plate areas 23 will, in the typical example, have a thickness of about 0.250 inch. The printing plate 21 will typically leave portions of the plate cylinder surface 18 exposed, both in the circumferential and longitudinal (i.e., axial) extent thereof. The raised print areas 23 have ink applied thereto from the anilox roll 12 during the rotation of the rolls, which rolls are all driven in a conventional manner from a drive source (not shown).

The overall arrangement and features of the flexographic press 10, as described above, are conventional and well-known.

According to the present invention, the press 10 is provided with a washing arrangement 30 disposed for cooperation with the print roll 11 to permit removal of debris and ink from the print plate, specifically the raised print areas 23, when desired.

Referring specifically to FIGS. 2–5, the washing apparatus 30 includes an elongate housing 31 which is of a generally channellike or trough-shaped cross section. The housing 31 is disposed adjacent the periphery of the print roll so that the longitudinal axis or lengthwise extent of the housing extends generally parallel with the axis 16 (FIG. 1) of the print roll. The housing 31 has a length which is normally somewhat shorter than the overall axial length of the plate cylinder 17, and the housing 31 is disposed so as to be positioned adjacent a lower quadrant of the periphery of the print roll. That is, the washing apparatus is preferably disposed so that the housing is adjacent one side of the print roll but spaced somewhat downwardly from the horizontal diametral plane of the print roll.

Figure 2:
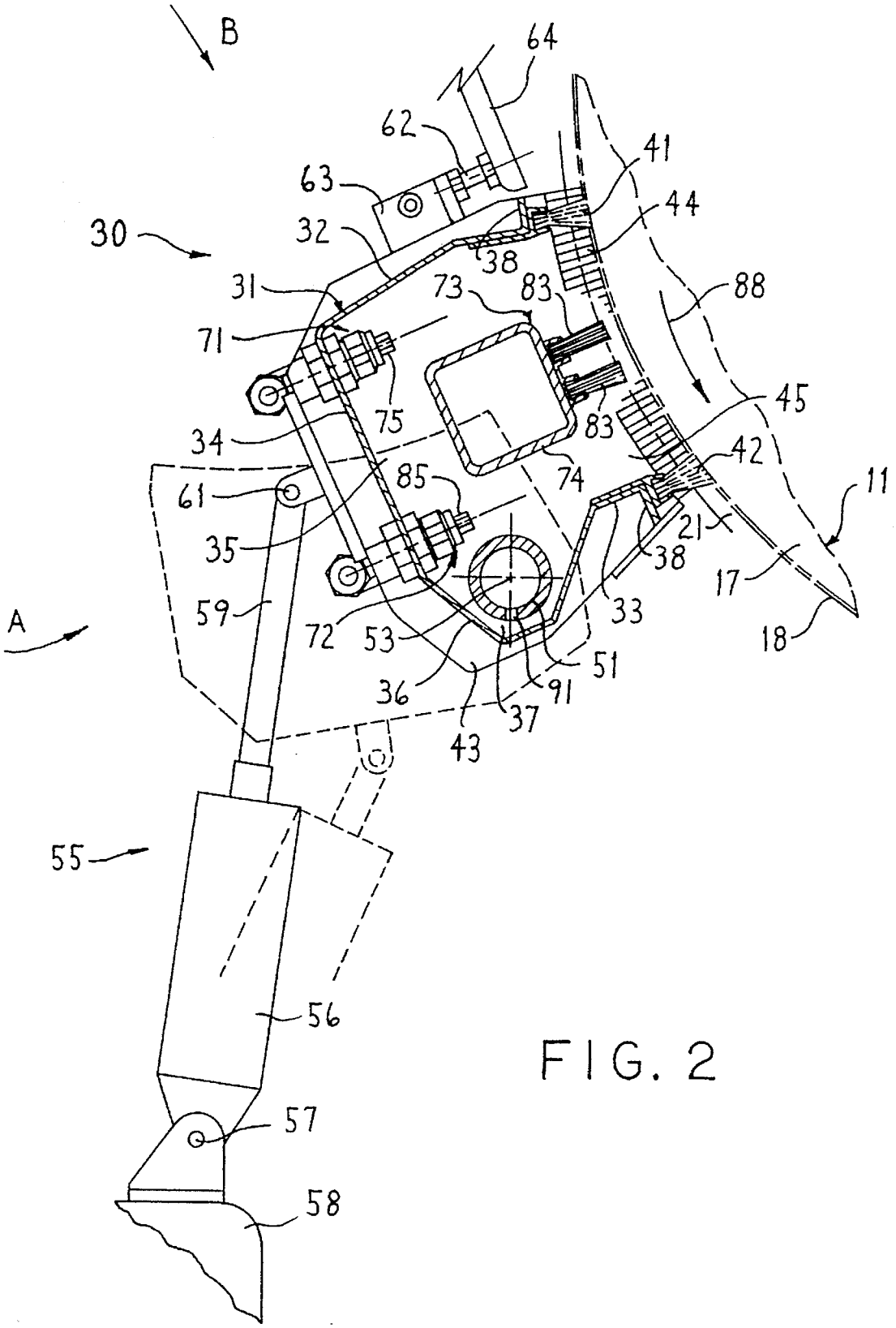
FIG. 2 is a fragmentary enlargement of a part of FIG. 1 and showing the improved washing apparatus of this invention as associated with the print roll, with the washing apparatus being shown in cross section.

The housing 31 basically includes top and bottom walls or legs 32 and 33 respectively, which are joined together by a back or base leg 34 so as to define an interior cavity or chamber 35. The bottom leg 33, as shown in FIG. 2, has a generally truncated V-shaped depression 36 therein so as to define a collecting well or reservoir 37 in the lowermost part of the chamber 35. The top and bottom walls 32 and 33 also each terminate in a longitudinally extending edge flange 38, and these respectively mount thereon longitudinally elongate top and bottom seal elements 41 and 42 which extend longitudinally throughout the length of the housing and project outwardly in a direction which is generally radially inwardly toward the roll 11 so as to maintain at least a partial sealing contact with the periphery 18 of the cylinder 17 when the washing apparatus is in the operational position illustrated by solid lines in FIG. 2.

The housing 31 also includes end flange members 43 which are fixed to and effectively close off opposite ends of the channel-shaped housing. Each of these end members 43 also mounts thereon an elongate seal strip 44 which is fixed to a front edge of the respective end flange 43 and projects outwardly therefrom toward the peripheral surface 18 of the cylinder 17 so as to maintain at least a partial sealing contact therewith when the washing apparatus is in the operational position. The two edge seal strips 41 and 42, and the two end seal strips 44, are each preferably constructed as an elongate brush strip wherein there is provided an elongate backing member having a plurality of flexible brush bristles projecting outwardly therefrom, which bristles project toward and normally maintain a position of engagement or contact with either the plate cylinder surface 18 or the printing plate 21 when the washing apparatus is in the operational position.

The housing 31 hence defines a generally elongated rectangular opening or mouth 45 which is surrounded by the brush strips 41, 42 and 44, with this mouth 45 being disposed closely adjacent and opening directly toward the periphery of the print roll when the housing is in the position shown in FIG. 2.

The washing apparatus 30 is movable between the operational position shown by solid lines in FIG. 2, and a non-operational position as indicated generally by dotted lines in FIG. 2. For this purpose, support shafts 51 at each end of the washing arrangement are secured to the frame of the machine, such as the frame plates 52, and these support shafts project into suitable openings formed in the housing end flanges 43 for pivotally supporting the washing arrangement 30 for pivoting movement about the axis 53 of the support shafts 51.

An actuator 55 (FIGS. 2 and 3) is provided for effecting movement of the washing apparatus between the operational and non-operational positions. This actuator 55, in the illustrated embodiment, includes a fluid pressure cylinder 56 (normally a pneumatic cylinder) whose lower end is connected by a horizontal pivot or hinge 57 to a frame part 58. The cylinder has an extendable piston rod 59 which, at its free end, is pivotally connected at 61 to one of the housing end flanges 43. A pair of such cylinders 56 are provided, each being connected to one of the housing end flanges. When these cylinders 56 are energized and extended, the washing apparatus 30 is pivoted about the axis 53, which extends parallel with the print roll axis, from the dotted inoperational position into the solid line operational position shown in FIG. 2.

To control the position of the washing apparatus relative to the print roll when in the operational state, there can additionally and preferably be provided an adjustable stop mechanism. This stop mechanism, in the illustrated embodiment, includes a stop member 62 which is threaded to and hence adjustable relative to a flange 63 secured to the end plate of the housing 31, and this adjustable stop 62 contacts a stop flange 64 fixed to the frame when the washing apparatus is swung into the operational position.

To effect proper cleaning of the print roll and specifically the raised print areas 23 of the printing plate, the washing apparatus preferably includes a first spray arrangement 71 for spraying a cleaning liquid onto the periphery of the print roll, followed by a second spray arrangement 72 for spraying a rinsing liquid onto the surface of the print roll so as to effectively remove the cleaning liquid as well as the ink and debris from the print areas. The washing arrangement also preferably incorporates a brushing arrangement 73 for effecting physical brushing of the print areas, this brushing arrangement preferably being positioned for contact with the print areas on the roll downstream of the washing liquid impingement region but upstream of the rinsing liquid impingement region. The washing apparatus in addition has an evacuation structure associated with the interior chamber 35 for removing (i.e., sucking) the liquids and debris from the chamber, as explained below.

More specifically, the first spray arrangement 71 in effect constitutes an elongate spray bar which extends longitudinally of the housing 31 and includes a plurality of individual but longitudinally spaced nozzles 75 which are mounted on the housing back wall 34 adjacent the upper end thereof and which are all directed inwardly so as to discharge a spray or jet of cleaning liquid directly toward the mouth of the housing for direct impingement with the surface of the print roll in the vicinity of the upper seal strip 41. The plurality of nozzles 75 are connected to a common supply pipe 76 which in turn connects to an exterior pressure source, such as a pump-reservoir combination, which supplies cleaning liquid to the nozzles 75. The cleaning liquid is normally water, preferably mixed with soap (or detergent) since such is highly effective for removing conventional liquid inks as utilized in flexographic printing.

The brushing arrangement 73 is positioned interiorly of and extends longitudinally throughout the housing chamber 35 and is positioned generally just below the spray nozzles 75 so that the brushing arrangement cooperates with the surface of the print roll after it has been sprayed by the nozzles 75. The brush arrangement 73 in the illustrated embodiment includes a longitudinally elongate support bar 74 which is slidably supported on and projects outwardly through the opposite housing end flanges 43. One projecting end of the support bar 74 is connectable with or connected to a drive arrangement 78 which effects a short-stroke reciprocation of the brush bar 74, substantially as indicated by the arrow 79 in FIG. 3. This drive device 78 may comprise a conventional rotary motor having a connecting rod 81 connected to an eccentric crank associated with the motor, with the connecting rod at its other end 82 being connected to the end of the brush bar 74. The connection 82 may be a permanent one involving swivel joints or the like so as to permit it to remain connected when the washing housing is moved into the non-operational position, or in the alternative the connection 82 may comprise a simple removable connecting element or pin which can be easily manually installed whenever the washing apparatus is moved into the operational position.

The brushing apparatus 73 in the illustrated embodiment includes a pair or longitudinally elongated brush strips 83 which are secured to the brush bar 74 and project therefrom outwardly through the mouth of the housing for engagement with the print plate 21 as the print roll rotatably moves past the housing mouth. The two brush strips 83 are preferably spaced apart in the circumferential direction of the print roll so as to effect sequential brushing contact regions with the print areas on the roll. Further, each of the brush strips 83 is formed by a plurality of flexible brush bristles which project outwardly toward the roll, but the length of the bristles associated with the strips 83 is normally selected so that the bristles associated with brush strips 83 will contact solely the raised print areas 23 to effect cleaning thereof.

The other spray arrangement 72 is constructed similar to the spray arrangement 71 and includes a plurality of separate spray nozzles 85 which are mounted on the rear housing wall 34 adjacent the lower part thereof, with the plurality of spray nozzles 85 being disposed generally within a longitudinally extending row so as to form a spray bar. The plurality of nozzles 85 are joined to an exterior supply pipe 86. This latter pipe 86 also couples to a separate liquid source, such as a pump-reservoir, which supplies a pressurized rinsing liquid to the nozzles 85. The pressurized rinsing liquid preferably comprises water which may be cold or warm.

The rinsing nozzles 85 are positioned downwardly from the cleaning nozzles 75, and are directed so that they eject sprays or jets of rinse water in a generally parallel direction to the nozzles 75, with the rinsing jets being directed outwardly through the opening of the washing housing for direct impingement against the print areas on the roll at a location just below (and hence downstream of) the brush strips 83.

The cleaning and rinsing liquids which are discharged from the respective nozzles against the print roll are generally effectively maintained within the compartment 35 due to the manner in which the edge sealing strips (i.e. the brush strips 41, 42 and 44) cooperate with the print roll 11 as the latter rotatably moves past the mouth of the housing in the direction indicated by the arrow 88 in FIG. 2. The liquids, as well as the debris contained with the liquids, hence collects within the chamber 35 and specifically gravitates into the reservoir 37 defined in the lower rear part of the housing.

Figure 3:
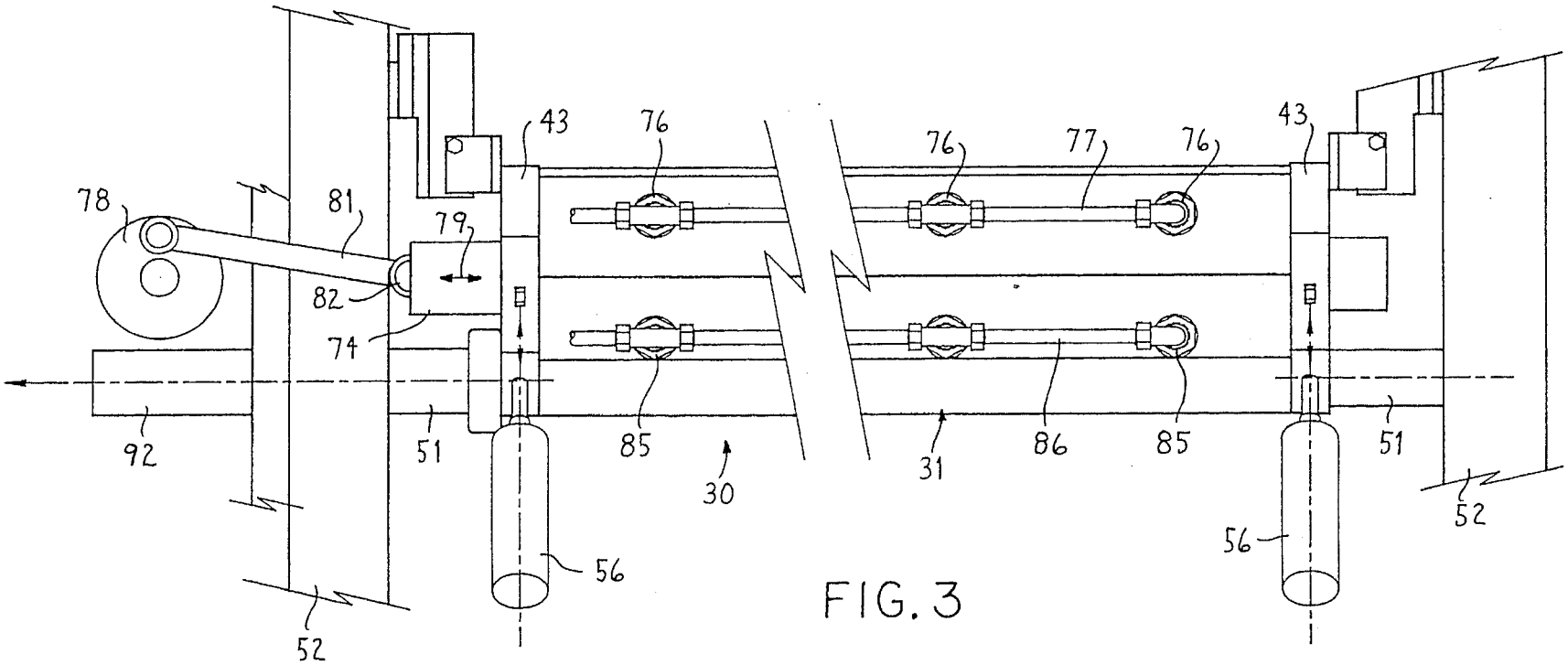
FIG. 3 is a view showing the back side of the washing apparatus, this view being on a reduced scale and taken generally along the direction indicated by arrow A in FIG. 2.
Figure 4:
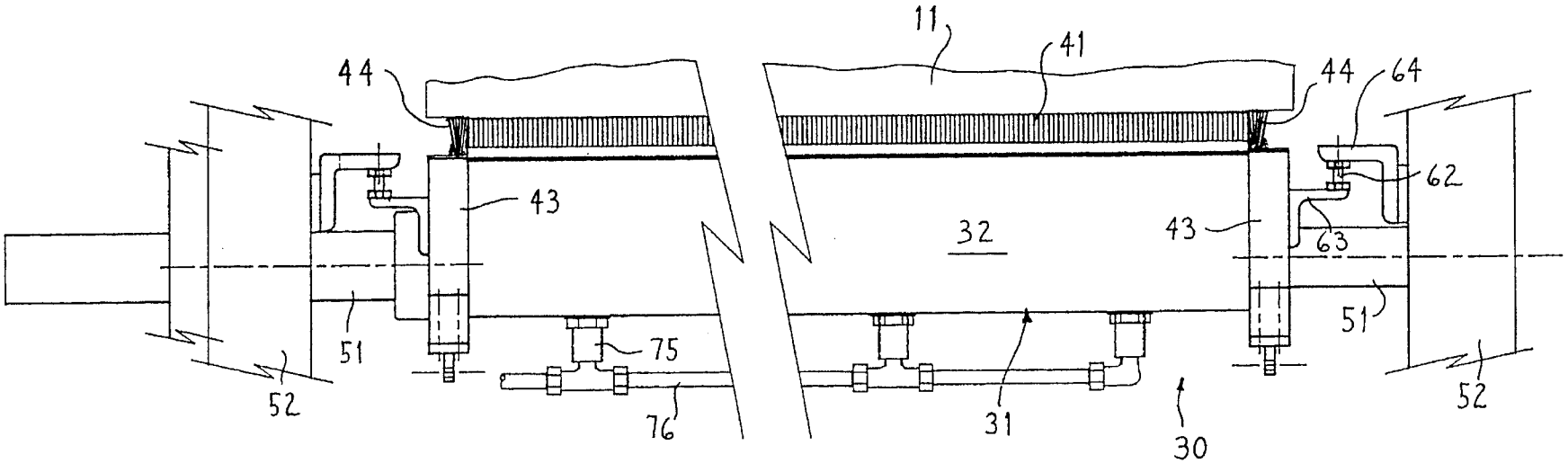
FIG. 4 is a top view of the washing apparatus, this view being on a reduced scale and taken generally along the direction indicated by arrow B in FIG. 2.
Figure 5:
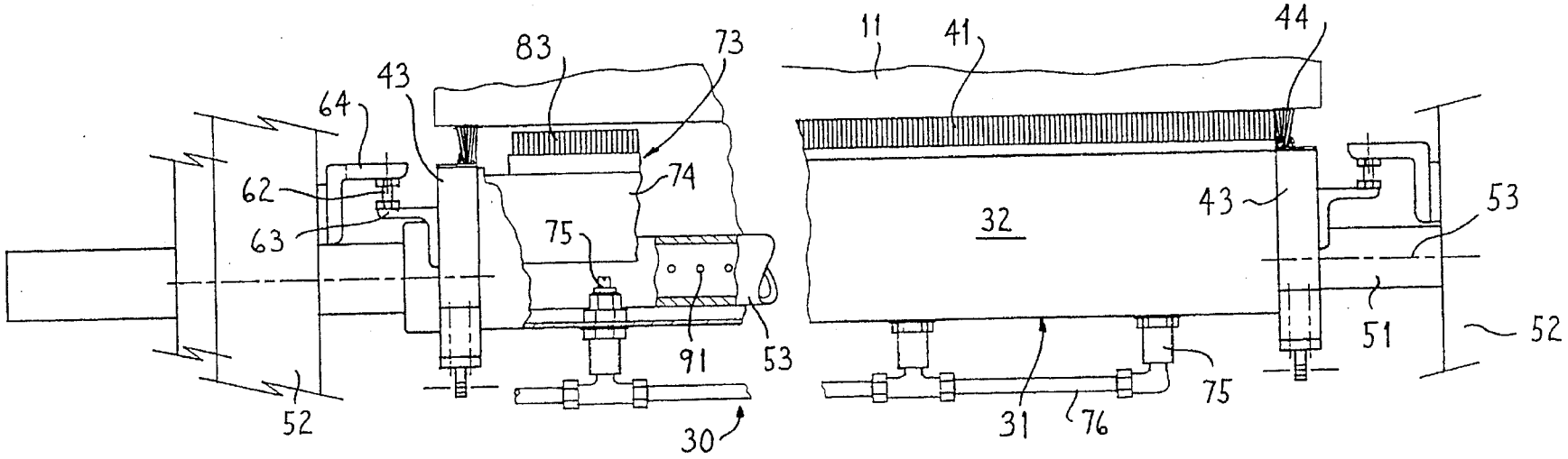
FIG. 5 is a view corresponding to FIG. 4 but the housing is partially broken away to show the interior components of the washing apparatus.

The housing also connects to a drain or discharge device for removing the liquids and debris. For this purpose, and in the illustrated and preferred embodiment, the support shaft 51 extends longitudinally throughout the interior of the housing 31 and is positioned so as to be disposed within the lower reservoir 37, substantially as illustrated in FIG. 2. The support shaft 51 is preferably a hollow tube and is provided with a plurality of openings or perforations 91 formed in the lower part thereof in axially spaced relation therealong. One end of the shaft 51 is closed, and the other end thereof, such as the end 92 shown in FIG. 3, is connected through a suitable conduit or the like (not shown) to a suction source (not shown), such as a conventional vacuum pump, so as to suck the liquid and debris from the reservoir 37 into the interior of the shaft or tube 51, and thence axially therealong for collection in an exterior reservoir. The operation of the washing apparatus will now be briefly described to ensure a complete understanding thereof.

When washing of the print areas 23 on the print roll 11 is desired, the cylinders 56 will be energized to move the washing arrangement 30 from the non-operative dotted position of FIG. 2 into the operative position shown by solid lines in FIG. 2. In this position, the stops 62 will typically be provided so as to contact the stop flanges 64, in which position the edge brush strips 41, 42 and 44 will all be in contact with either the plate cylinder surface 18 or the print plate surfaces so that the mouth of the housing is effectively sealed around the periphery thereof.

At this time, the drive for the reciprocating brush bar 74 will also be connected if a disconnectable type drive is being utilized.

In the washing position, the print roll 11 will also be rotated in the normal direction, such as indicated by the arrow 88 in FIG. 2, which results in the surface of the print roll being moved generally downwardly across or past the mouth 45 of the washing housing. As the roll is moved, the bristles associated with the edge sealing strips 41, 42 and 45 will all suitably deflect as necessary so as to accommodate the increased thickness or radial dimension caused by the backing plate 22 or the raised print areas 23.

The downward movement of the print roll surface past the mouth of the washing housing is accompanied by the supplying of cleaning and rinsing liquid by the nozzles 75 and 85, respectively, simultaneous with the activation of the brush 73. More specifically, pressurized cleaning liquid and preferably a water-soap solution is ejected from the nozzles 75 outwardly through the mouth 45 against the roll surface which moves downwardly past the upper seal strip 41. This cleaning liquid contacts the raised print areas 23 and the water-soap solution is highly effective for removing the liquid inks conventionally utilized in flexographic printing. Further, the pressurized cleaning liquid is also effective in dislodging and removing debris which contaminates the ink. After the printing area has been wetted by the spray from the cleaning nozzle 75, this area thence rotates downwardly and comes into contact with the brushing arrangement 73 which, in the illustrated embodiment is a short-stroke reciprocating brush whereby the two brush strips 83 contact the raised print areas and are reciprocated back and forth across the raised print areas at the same time as these areas move downwardly past the brush strips. This hence creates a compound relative movement which is effective in dislodging additional ink and dislodging any debris which is caught in the raised print areas.

Thereafter the roll surface continues to move downwardly and moves into the region where the cleaning nozzles 85 discharge a spray of pressurized rinse liquid and particularly water thereagainst. The pressurized rinsing water discharged by the nozzles 85 is effective for additionally removing the ink and debris from the raised print areas, and at the same time also removes and rinses away any remaining soap solution. The rinse and cleaning liquids, and debris, fall into the interior compartment 35 and flow rearwardly thereof down into the collection reservoir 37. The flow of liquids and debris into the reservoir is further assisted by the fact that the washing housing preferably contacts a lower quadrant surface of the print roll as illustrated by FIG. 2, and hence gravity also tends to assist the discharge of liquids from the roll into the housing for collection within the reservoir 37.

Suction is applied to the outer end 92 of the suction tube 51, which hence sucks the liquids and debris from the reservoir 37 into the interior of the tube 51 for discharge to a suitable exterior point, such as an exterior collecting reservoir. This suction as applied to the interior of the compartment 35 is also effective in causing limited quantities of exterior air to be sucked through the edge brush strips 41, 42 and 44 into the compartment 35 and thence into the suction tube 51. This air, particularly the air which flows through the lower brush strip 42, assists in drying the surface of the print roll as it moves downwardly out of engagement with the washing apparatus.

The entire washing operation can be completed quickly and efficiently, typically during a single rotation of the print roll, whereby the print areas can be rapidly and efficiently cleaned without requiring major disassembly or significant shut down of the press.

While the illustrated and preferred embodiment illustrates a longitudinally reciprocating brush arrangement 73, it will be appreciated that other brush arrangements could be provided, including a rotatable brush arrangement.

In addition, while the edge seals 41, 42 and 44 are preferably formed by bristle-type brushes, other types of edge seal strips could be utilized provided that they still yield the desirably and necessary functional characteristics required for cooperation with a flexographic print roll.

Further, the suction tube 51 could be replaced by aligned stub shafts adjacent opposite ends of the housing, with one stub shaft functioning solely as a pivot, and the other stub shaft being a hollow tube which also functions as a pivot but is hollow and connected to the suction device to suck liquid and debris from the reservoir.

Still further, the suction tube could be totally separate from the hinge tube, and could be formed as a gravity-type drain passage in some uses and configurations, although use of a suction is normally preferred.

While FIG. 2 shows the roll rotation being downward (arrow 88) past the washing device, in some instances it may be preferable to position the washing device so that the roll rotation is upwardly past the housing. In this situation, the lower nozzles would discharge cleaning liquid and the upper nozzles would discharge rinse liquid.

In some use conditions, the cleaning liquid may be solely water, or water containing a suitable cleaning additive which is particularly suitable for use with a specific type of ink, such as an ink solubilizing formulation.

The cleaning operation described above and the accompanying rotation of the printing roll so as to permit cleaning thereof will normally occur when the press is in a non-operational state, that is, not during a printing cycle.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A washing arrangement for removing ink and debris from a printing plate mounted on a rotatable printing roll, said cleaning arrangement comprising:

an elongate channellike housing having an open mouth along one side thereof adapted to be positioned in close proximity to a peripheral surface of the printing roll, said housing defining therein an interior chamber including a lower reservoir for collecting liquid and debris;

edge sealing strips mounted on said housing in surrounding relationship to the mouth, said edge sealing strips being disposed for contact with the peripheral surface of the printing roll;

a first spray bar mounted adjacent the housing and including a plurality of longitudinally spaced first nozzles for discharging cleaning liquid through the mouth of the housing onto the surface of the printing roll, and said first spray bar being connected to a first source which supplies the cleaning liquid to the respective first nozzles;

a second spray bar mounted adjacent the housing and including a plurality of longitudinally spaced second nozzles for discharging rinse liquid through the mouth of the housing onto the surface of the printing roll, said second spray bar being connected to a second source for supplying rinse liquid to the respective second nozzles, and said second nozzles being mounted on said housing relative to said first nozzles such that the rinse liquid discharged from said second nozzles contacts a region of said printing roll which is positioned downstream of the region of the printing roll contacted by the cleaning liquid discharged by said first nozzles; and a drain member communicating with the reservoir of said housing for discharging the liquids and debris from the housing.

2. An apparatus according to claim 1, wherein the drain member comprises an elongate hollow tube which is positioned interiorly of the housing within the lower portion of the reservoir and projects longitudinally of the housing, the hollow tube having openings formed through a wall thereof for communication with the reservoir, said tube being connected to a suction device.

3. An apparatus according to claim 2, wherein the hollow tube projects outwardly beyond opposite longitudinal ends of the housing and is supported on a stationary frame, said hollow tube cooperating with said housing to define a longitudinally extending pivot axis which extends generally parallel with the axis of rotation of the printing roll and permits the housing to be pivotally moved between an operative position wherein the housing cooperates with the printing roll and an inoperative position wherein the housing is spaced outwardly away from the periphery of the printing roll.

4. An apparatus according to claim 3, including a drive unit cooperating between the housing and the frame for movably pivotably displacing the housing between said operative and inoperative positions.

5. An arrangement according to claim 1, including a longitudinally elongated brush movably supported on the housing and extending longitudinally along the interior chamber thereof, said brush being positioned directly adjacent and extending longitudinally along the mouth of the housing and having bristles which project outwardly of the mouth for contacting the printing roll, and a driving device connected to the brush for effecting movement thereof relative to the housing during a cleaning operation.

6. An arrangement according to claim 5, wherein the brush is positioned for contact with a region of the printing roll which is disposed circumferentially between the regions which are directly contacted by the liquid discharged from the first and second nozzles.

7. An arrangement according to claim 6, wherein bristles associated with the brush project outwardly for contact solely with raised print areas on the printing roll.

8. An arrangement according to claim 7, including a pivot member cooperating between the housing and a frame for defining a pivot axis which extends parallel to the rotation axis of the printing roll and permits the housing to be pivotally moved between an operative position wherein the housing is adjacent the roll and an inoperative position wherein the housing is spaced radially outwardly away from the roll.

9. An arrangement according to claim 8, wherein the pivot member defines a hollow tube which projects longitudinally into the interior chamber of the housing generally within the reservoir, said hollow tube having an opening for communication with the reservoir, and a suction source connected to said hollow tube for sucking liquid and debris from the reservoir through the tube for exterior discharge.

10. An arrangement according to claim 9, including a fluid pressure cylinder coupled between the frame and the housing for movably displacing the housing between said operative and inoperative positions.

11. An arrangement according to claim 7, wherein the longitudinally elongate brush comprises an elongate brush bar which is supported and driven for longitudinally reciprocal movement and which includes a pair of generally parallel longitudinally elongate brush strips which are disposed adjacent but are spaced from one another in the circumferential direction of the roll and project outwardly of the mouth for creating two areas of brushing contact with the raised print areas as they move past the mouth of the housing.

12. An arrangement according to claim 1, wherein the edge sealing strips are defined by elongated brush strips having flexible bristles which project into contact with the roll.

13. In a printing arrangement having an axially elongated print roll supported for rotation about a generally horizontally extending axis, said print roll having a surrounding peripheral surface defining ink-bearing print areas thereon, and a cleaning arrangement positioned adjacent and extending longitudinally along the print roll at a selected peripheral location for permitting removal of ink and debris from the peripheral surface of the print roll, the improvement wherein said cleaning apparatus comprises:

an elongate troughlike housing positioned adjacent and extending longitudinally along said print roll, said housing defining therein an interior compartment, and said housing having an elongate opening formed on one side thereof which is positioned closely adjacent and directly faces the peripheral surface of the print roll when the housing is in said selected location;

a first spray nozzle positioned within said housing for discharging a pressurized cleaning liquid outwardly through the opening for impingement against a first peripheral region of the print roll;

a second spray nozzle positioned interiorly of the housing for discharging a pressurized rinse liquid outwardly through the opening for impingement against a second peripheral region of the print roll which is spaced circumferentially from said first peripheral region;

a longitudinally elongate brush positioned within said housing and extending longitudinally thereof, said brush having bristles which project outwardly of the opening for contact with the print areas on the print roll; and a passage-defining element communicated with the interior compartment of said housing for permitting discharge of liquids and debris therefrom.

14. A printing arrangement according to claim 13, wherein said brush is disposed for contacting a third peripheral region of said print roll which is disposed generally between said first and second peripheral region.

15. A printing arrangement according to claim 13, wherein said housing defines a lower wall part which defines a reservoir for collecting liquids and debris therein, said reservoir being in open communication with the interior compartment and defining the lowermost part of said interior compartment, and said element communicating with said reservoir.

16. A printing arrangement according to claim 15, wherein said element comprises an elongate suction tube which extends longitudinally relative to said housing and communicates with said reservoir, said suction tube projecting outwardly of the reservoir and defining a pivot support for permitting the housing to be pivotally moved between an operative position directly adjacent the print roll and a non-operative position wherein the housing is spaced radially outwardly a substantial distance from the periphery of the print roll.

17. A printing arrangement according to claim 13, including a plurality of elongate brush strips mounted on said housing in surrounding relationship to the periphery of said opening, said brush strips projecting outwardly for engagement with the periphery of the roll for confining the cleaning and rinsing liquids within the compartment.

18. A printing arrangement according to claim 13, wherein said selected location is defined generally adjacent one side of but below a horizontal diametral plane of said roll, and on the side of said roll such that the peripheral surface of the roll rotates generally downwardly past the opening of the housing during the washing operation, and said first nozzle being mounted on said housing in vertically spaced relation from said second nozzle.

19. A printing arrangement according to claim 18, wherein said brush is positioned generally between said first and second nozzles when viewed in the direction of roll rotation.

20. A printing arrangement according to claim 19, including elongate brush strips mounted on said housing around the periphery of said opening, said brush strips having flexible bristles which project outwardly for contact with the roll surface to confine the liquids within the compartment.

21. A washing arrangement for removing ink and debris from a printing plate mounted on a rotatable printing roll, said cleaning arrangement comprising:

first spray means mounted adjacent the printing roll and including a plurality of longitudinally spaced first nozzles for discharging cleaning liquid therefrom against a first peripheral region of the printing roll, said first spray means being connected to a first source which supplies the cleaning liquid to the respective first nozzles;

second spray means mounted adjacent the printing roll and including a plurality of longitudinally spaced second nozzles for discharging rinse liquid therefrom against a second peripheral region of the print roll which is spaced downstream of the first peripheral region, said second spray means being connected to a second source for supplying rinse liquid to the respective second nozzles;

a longitudinally elongated brush positioned adjacent and extending longitudinally along the printing roll adjacent the peripheral surface thereof, said brush being disposed for contacting the peripheral surface of the printing roll at a region which is at or downstream of said first region but upstream of said second region, said brush having bristles which project outwardly for contact with the printing roll; and a liquid-collecting reservoir positioned downwardly from and generally under said first and second nozzles and said first and second peripheral regions for collecting the liquid which is sprayed against the periphery of the printing roll.

22. A washing apparatus according to claim 21, including an elongate strip extending longitudinally along and positioned for contacting engagement with the periphery of the printing roll at a location adjacent to but downstream of said second peripheral region for causing liquid on the roll to collect in the reservoir.

23. A washing apparatus according to claim 21, wherein a shroud is positioned to at least partially enclose the first and second spray nozzles, the shroud including a top wall which is disposed above the first nozzles and projects inwardly toward the periphery of the printing roll, and a rear wall which projects downwardly from the top wall at a location so that the first and second spray nozzles are confined generally between said rear wall and the periphery of the printing roll.

24. A washing apparatus according to claim 21, including a driving device connected to the brush for effecting movement thereof during a cleaning operation.

25. A washing apparatus according to claim 24, wherein a shroud is positioned to at least partially enclose the first and second spray nozzles, the shroud including a top wall which is disposed above the first nozzles and projects inwardly toward the periphery of the printing roll, and a rear wall which projects downwardly from the top wall at a location so that the first and second spray nozzles are confined generally between said rear wall and the periphery of the printing roll.

26. A washing apparatus according to claim 21, wherein bristles associated with the brush project outwardly for contact solely with raised print areas on the printing roll.

* * * * *